United States Patent [19]

Inoue

[11] 4,367,051

[45] Jan. 4, 1983

[54] RELATIVE TIME INTERVAL MEASURING INSTRUMENT

[76] Inventor: Akigoro Inoue, Otsu 3, Sekimachi, 1 chome, Nerima-ku, Tokyo, 177, Japan

[21] Appl. No.: 201,093

[22] PCT Filed: Aug. 21, 1979

[86] PCT No.: PCT/JP79/00222

§ 371 Date: Apr. 23, 1980

§ 102(e) Date: Apr. 7, 1980

[87] PCT Pub. No.: WO80/00503

PCT Pub. Date: Mar. 20, 1980

[30] Foreign Application Priority Data

Aug. 23, 1978 [JP] Japan ..... 53-103197

[51] Int. Cl.[3] ..... G04F 8/00; G04F 10/00

[52] U.S. Cl. ..... 368/111; 368/10; 368/2

[58] Field of Search ..... 368/1, 2, 3, 10, 72, 368/73, 111, 110, 251; 235/92 T; 364/705, 710

[56] References Cited

U.S. PATENT DOCUMENTS

| | | | |
|---|---|---|---|
| 4,035,627 | 7/1977 | Dickinson | 368/10 X |
| 4,094,138 | 6/1978 | Chetelat et al. | 368/111 |
| 4,104,865 | 8/1978 | Sasaki | 368/251 X |
| 4,166,360 | 9/1979 | Yamaguchi | 368/3 |

FOREIGN PATENT DOCUMENTS

| | | |
|---|---|---|
| 51-45950 | 4/1976 | Japan . |
| 51-56672 | 5/1976 | Japan . |
| 53-81168 | 7/1978 | Japan . |
| 54-03971 | 1/1979 | Japan . |

*Primary Examiner*—Ulysses Weldon
*Assistant Examiner*—Bernard Roskoski
*Attorney, Agent, or Firm*—Pollock, VandeSande & Priddy

[57] ABSTRACT

Upon depression of a number key, the timer memory corresponding thereto is started to be in its counting operation state, and when the number is depressed again, the timer memory stops its counting operation. When a relative difference key is depressed, a maximum (or minimum) value is selected from the count contents of respective timer memories and then, when the relative difference key is depressed repeatedly, a difference between the selected value and each of the other count contents in a decreasing (or increasing) order, the number of the number key corresponding to the count contents and its ranking are displayed on a display unit upon each depression of the relative difference key. With one instrument, it is possible to obtain a plurality of timer operations, the ranking of the measured results and their relative differences.

7 Claims, 18 Drawing Figures

| RANKING | KEY # | sec. $\frac{1}{10}$ sec. |
|---|---|---|
| 1 | 8 | 0.0 |
| 2 | 3 | 2.7 |
| 3 | 7 | 2.7 |
| 4 | 1 | 5.9 |
| 5 | 2 | 9.8 |
| 6 | 5 | 9.8 |
| 7 | 9 | 14.9 |
| 8 | 0 | 19.8 |
| 9 | 4 | 24.2 |
| 10 | 6 | 36.4 |
| 1 | 8 | 0.0 |

START

S45
FGRUN ← 0
S46
FGSTP ← 1
S47
FIRST KEY INPUT ?
NO
YES
S48
SELECT MINIMUM FROM M1 – MD
S49
SET MINIMUM IN MIN. VALUE MEM.
S50
CLEAR DISPLAY BUFF.
S51
RANKING MEM. ← 1
KEY # MEM. ← TIMER #
S52
SELECT MINIMUM FROM M1 – MD
S53
COMPARED ?
YES
NO
S54
CALC. MEM. ← COUNT
S55
CALC. MEM. ← MINIMUM
S56
DISPLAY BUFF. ← DIFF.
S57
RANKING MEM. ← +1
S58
KEY MEM. ← TIMER #
S59
FGSB ← 1
S60
FGTR ← 0
S61
COMPARISON BIT ← 1
END

RELATIVE TIME INTERVAL MEASURING INSTRUMENT

TECHNICAL FIELD

This invention relates to a relative time interval measuring instrument which is capable of simultaneously measuring a plurality of time intervals and providing displays of differences between, for example, the shortest one of the measured time intervals and the others and their ranking.

BACKGROUND ART

For example, in a certain contest, for measuring the time of each of the contestants who start all together but reach the goal separately, use has been made of stopwatches in the past. Since the stopwatch is operated by man, only two stopwatches can be handled by both hands and, in the case of the contestants being three or more, two or more timekeepers are needed.

Further, in the case where before measurement of one object is finished, measurement of another object is started, that is, in the case where measurements of many objects are started one after another, only two objects could be measured by one person using stopwatches.

It is important in some cases to clock many contestants and learn how much difference exists between a minimum one of their times and the other. In the past, it has been necessary to calculate such difference by hand.

According to the conventional stopwatch, if it is used again after one measurement, the previous measured value is removed; therefore, it must be recorded on paper or the like.

An object of this invention is to provide a relative time interval measuring instrument which is capable of measuring a plurality of times simultaneously with one instrument, displaying in the form of quantity a difference between, for example, a shortest one of the measured times and each of the others, and displaying their ranking, and which is able to display one measured time and, after displaying other measured times, display the previously one, that is, a relative time interval measuring instrument which has a function of measuring a plurality of times and a function of calculating the measured values.

Next, the relative time interval measuring instrument of this invention will be described with reference to the drawings.

DISCLOSURE OF THE INVENTION

According to this invention, there are provided a plurality of keys, a relative difference key, timer memories corresponding to the number keys and individually performing counting operation in the time interval from their start to stop and a display unit. Upon depression of one of the number keys, the timer memory corresponding thereto is started to perform its counting operation, and when the number key is depressed again the corresponding timer memory is stopped from operation.

Upon depression of the relative difference key, a maximum (or minimum) value is selected from the count contents of the timer memories; and when the relative difference key is depressed subsequently, a difference between the abovesaid selected value and each of the other count contents in a decreasing (or increasing) order is calculated upon each depression of the relative difference key, and the calculated difference is displayed on the display unit together with the number of the number key corresponding to each count content and its ranking.

Further, a simultaneous start key is provided, and by its depression, all of the timer memories can be started or stopped simultaneously. Moreover, a time key is provided, and by depressing this key and one of the number keys, the count content of the timer memory corresponding to the number key can be displayed at will. Furthermore, an auto-key is provided, and upon each depression of this key, the timer memories are stopped one by one in a predetermined order.

BRIEF DESCRIPTION OF THE DRAWINGS

FIG. 8 is an operational flowchart in the case of a power source being turned ON;

BEST MODE FOR CARRYING OUT THE INVENTION

Figure 1:
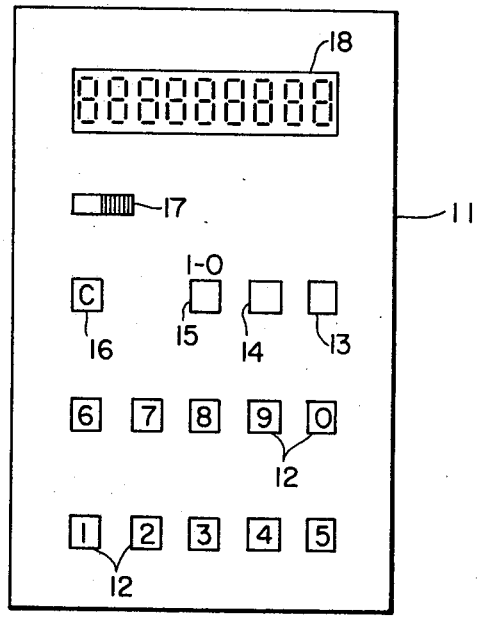
FIG. 1 is a plan view showing an example of the relative time interval measuring instrument of this invention.

The relative time interval measuring instrument of this invention has, on one surface of a case 11, number keys 12 bearing numbers 0 to 9, a relative difference key 13, a time key 14, a simultaneous start key 15 and a clear key 16, as shown in FIG. 1. Further, there are provided a power source switch 17 and a display unit 18.

Figure 2:
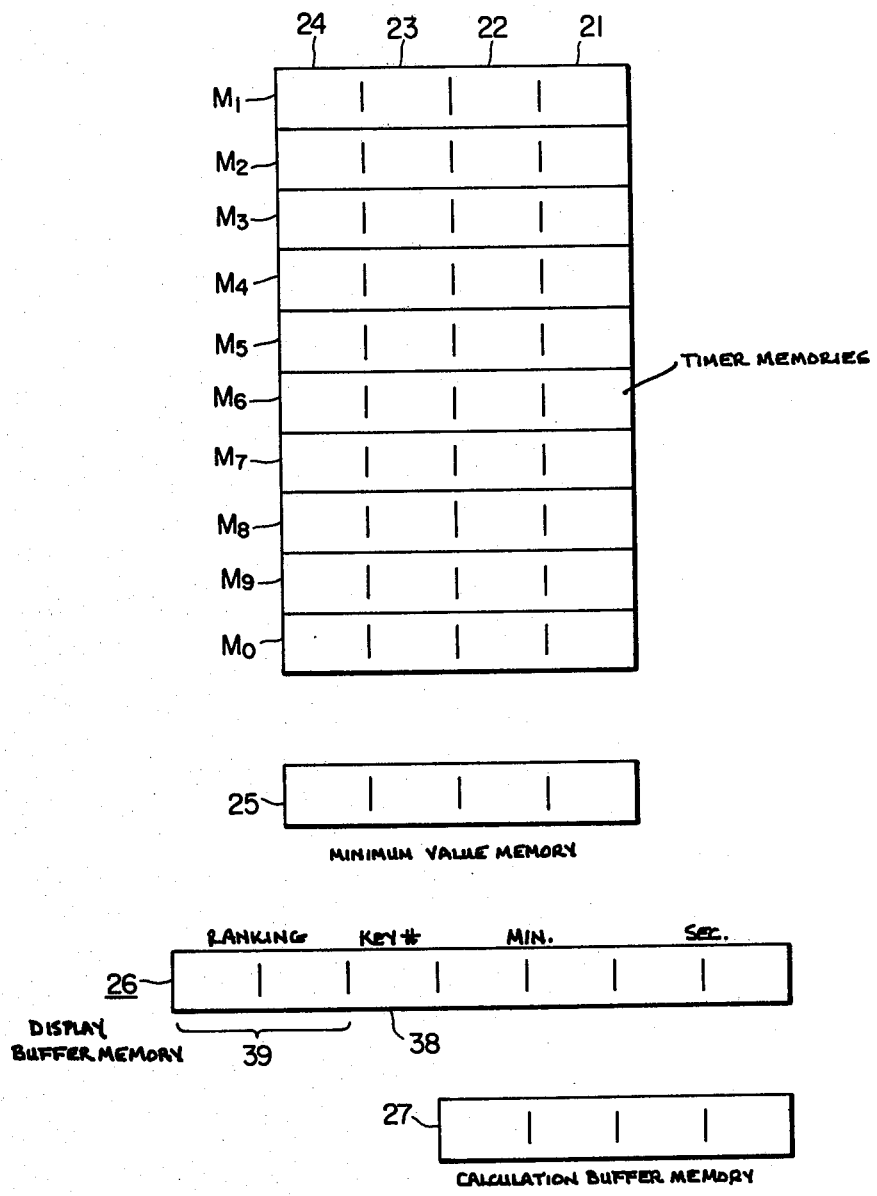
FIG. 2 is a block diagram showing various memories for use in this measuring instrument.

In the state in which the simultaneous start key 15 has not been depressed, the number keys 12 each serve as a start key when depressed a first time, and serve as a stop key when depressed a second time. Further, there are provided in the case 11 timer memories $M_0$ to $M_9$ respectively corresponding to the number keys 12, i.e. ten number keys bearing the numbers 0 to 9 in this example, as shown in FIG. 2. In this embodiment, each timer memory has a storage area 21 for 1/10 second, a storage area 22 for a first digit of a second, a storage area 23 for a second digit of the second and a storage area 24 for a first digit of a minute.

Further, there is provided a minimum valve memory 25 for storing a minimum one of a plurality of measured time intervals, as will be described later, and a display buffer memory 26 is also provided in which are stored data to be displayed in respective digit positions of the display unit 18. Also, a calculation buffer 27 for calculation use is provided in the memory.

As described previously, by the depression of a desired one of the number keys 12, the corresponding timer memory is put into operative state and, at certain time intervals, the content of the timer memory is added with 1, performing the timer operation. By a second depression of the same number key, the counting operation of the corresponding timer memory is stopped. Upon depression of the simultaneous start key 15, the timer memories $M_0$ to $M_9$ start the timer operation concurrently, and when the number keys are each depressed later, the operation of the corresponding timer memory stops. That is to say, the number keys 12 are to designate the timer memories corresponding to their numbers and are used for starting or stopping of the timer memories or accessing thereto.

Upon depression of the relative difference key 13, a minimum one of the count contents of the timer memories $M_1$ to $M_0$ is selected and stored in the minimum value memory 25. Thereafter, upon each depression of this relative difference key 13, there are displayed the ranking, a difference between the content of the minimum valve memory 25 and each of the larger count values in increasing order and the number of the corresponding number key.

Depressing the time key 14 and then a desired one of the number keys, the content of the timer memory corresponding to the depressed number key is read out, and the number of the number key and the content of the timer memory are displayed on the display unit 18. The clear key 16 is to clear all the memories from their storage states.

Figure 3:
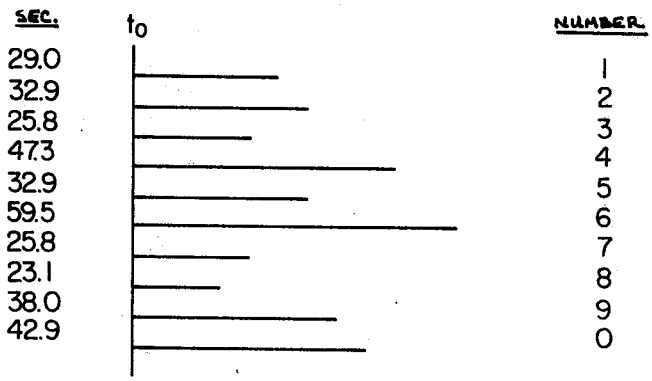
FIG. 3 is a diagram showing the state in the case of simultaneous starting and separate stopping of timer memories.

For example, in the case where the objects of measurement, No. 1 to No. 0, start all together at a moment $t_0$ and the measurements are stopped after different periods of time—29.0 sec. for No. 1, 32.9 sec, for No. 2, etc.—as shown in FIG. 3, the clear key 16 in FIG. 1 is depressed first to clear all the memories and then the simultaneous start key 15 is depressed at the moment $t_0$. As a consequence, the timer memories $M_1$ to $M_0$ operate at the same time. The objects of measurement No. 1 to No. 10 are made to have one-to-one correspondence to the numbers 1 to 0 of the number keys 12 in advance. In FIG. 3, the object No. 8 takes 23.1 sec., shorter than any others, and at the moment of this time having lapsed, the number key 12 bearing the number 8 is depressed. As a result of this, the operation of the corresponding timer memory $M_8$ stops. Next, the objects Nos. 3 and 7 are second, i.e. 25.8 sec., and at the moment of this time having lapsed, the number keys 12 bearing the numbers 3 and 7 are depressed concurrently. In a similar manner, upon each lapse of time for each of the other objects, the corresponding number key is depressed.

The measured times of the respective objects are stored in the corresponding timer memories $M_1$ to $M_0$.

In order to read out the times stored in the memories $M_1$ to $M_0$, the time key 14 is depressed first and then, if the number key 12 bearing the number 1 is depressed, the content of the memory $M_1$ is read out and 1, 29 and 0 are respectively displayed in the key number section, the second display section and the 1/10 sec. display section of the display unit 18. Then, if the number key 12 bearing the number 2 is depressed, 2 is displayed in the key number section and the content 32.9 of the memory $M_2$ is displayed with 32 in the second display section and 9 in the 1/10 sec. display section. In a similar manner, by depressing each of the other number keys, the content of the timer memory corresponding to the depressed number key and its number are displayed.

In this example, when the relative difference key 13 is depressed, a minimum value among the stored contents of the timer memories $M_1$ to $M_0$, 23.1 sec. stored in the memory $M_8$ in this example, is selected and stored in the minimum value memory 25. Further, since its ranking is the first, 1 is displayed in the ranking display section and the number 8 of the number key corresponding to the timer memory $M_8$ is displayed in the key number display section; furthermore, since the difference between the selected value and the minimum value is zero, 0 and 0 are displayed in the second display section and the 1/10 sec. display section respectively.

Thereafter, depressing the relative difference key 13, a ranking 2 is displayed in the ranking display section and the timer memory having stored therein the measured time second to the minimum value is selected, displaying the key number 3 corresponding to the memory in the key number key display section and a time difference 2.7 sec. between the stored content of the memory $M_3$, i.e. 25.8 sec. and the minimum value. Depressing the relative difference key 13 next, the ranking 3 is displayed, and 7 and 2.7 sec. are displayed in th key number section and, the time difference display section respectively. Thereafter, upon each depression of the relative difference key 13, the ranking, the corresponding key number and the relative difference are similarly displayed, as shown in FIG. 4.

Figures 4, 5:
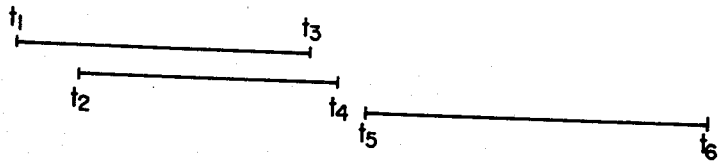
FIG. 4 is a diagram showing the state in which measured values are displayed one after another by the control of a relative difference key.
FIG. 5 is a diagram showing an example in which timer memories are started and stopped separately.

In the case where the objects of measurement start and stop separately, for example, in the case where there are three objects of measurement 1, 2 and 3 as shown in FIG. 5, they are made to have one-to-one correspondence to the numbers 1, 2 and 3 of the number keys 12 respectively. When a first object of measurement starts at a moment $t_1$, the number key of the number 1 is depressed at the moment $t_1$; when the second object of measurement starts at the next moment $t_2$, the number key 12 of the number 2 is depressed at that moment; and upon completion of the first measurement of time at the next moment $t_3$, the number key 12 of the number 1 is depressed again. The count value from this moment $t_1$ to $t_3$ is stored in the memory $M_1$ corresponding to the depressed number key. At the next moment $t_4$, the second measurement of time ends and the number key 12 of the number 2 is depressed at that moment $t_4$. Thereafter, at a moment $t_5$ the third measurement of time starts and, at that moment, the number key 12 of the number 3 is depressed to make the memory $M_3$ operative and when this measurement of time ends at a moment $t_6$, the number key of the number 3 is depressed again to stop the operation of the memory $M_3$.

In this way, time measurements for separately-operating objects of measurement are carried out. To display each measured result, the time key 14 is depressed first and then the number key of the number desired to be displayed is depressed, as in the foregoing case. When it is desired to display the difference relative to the first-place object, the ranking, the corresponding number and the time difference of each of the other objects are displayed by repeatedly depressing the relative difference key 13.

Such various operations described above can be performed; and these operations can be processed through the use of the so-called microcomputer.

Figure 6:
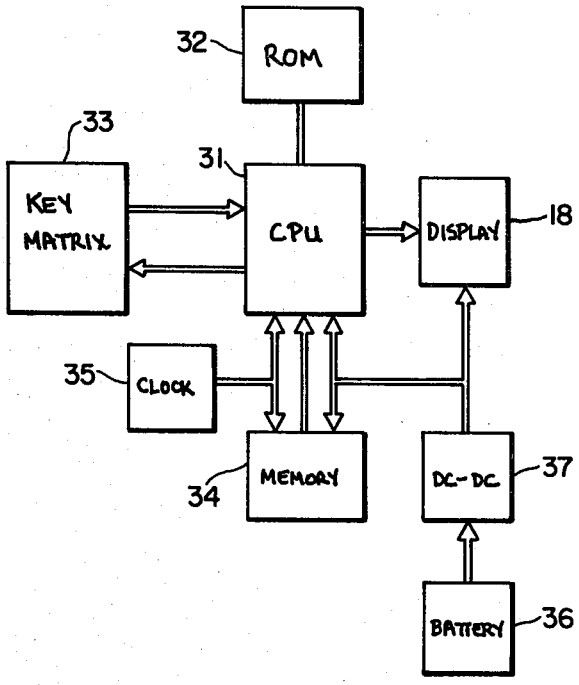
FIG. 6 is a block diagram illustrating an embodiment of the relative time interval measuring instrument of this invention which employs program control.

For example, as shown in FIG. 6, a central processor unit, i.e. the so-called CPU 31 successively reads, interprets and executes programs in a read only memory 32 having stored therein the programs for the above operations. To the central processor unit 31 are entered from a key matrix 33 signals representing the states of the various keys described previously in connection with FIG. 1. The timer memories $M_1$ to $M_0$ and other memories are connected as a memory 34 and a clock generator 35 for producing a fundamental clock of the timer operation is also connected and, further, the display unit 18 is connected. The electric power of a battery is converted by a DC-DC converter 37 into a predetermined voltage and supplied as the working power to the CPU 31 and the display unit 18.

Figure 7:
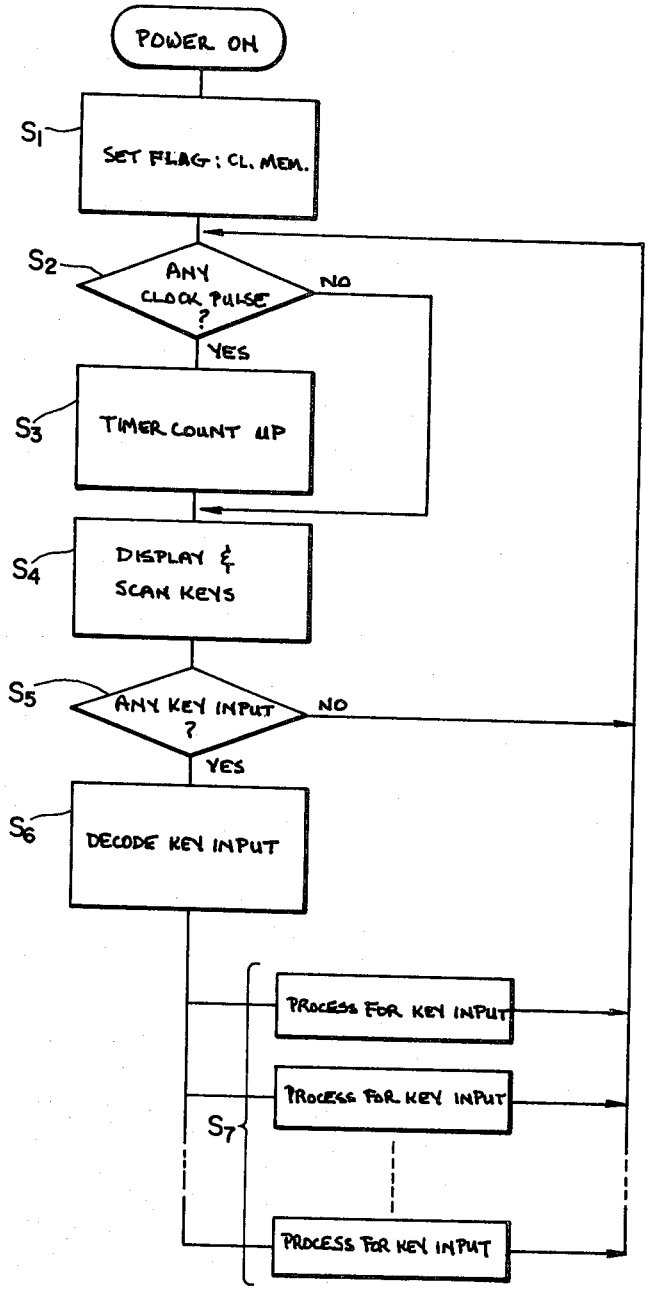
FIG. 7 is its entire operational flowchart.

The various operations described above are each carried out following, for example, a flowchart described hereunder. As shown in FIG. 7, when a power source switch is turned ON, the various memories are cleared in step $S_1$. A symbol B is inputted to each memory to indicate that it has been cleared. For providing a display of one digit of a decimal number, four binary bits are needed, but a binary value unnecessary for displaying one digit, for example, a binary number 1011 representing a decimal number 11 is utilized as the symbol B. The number 1011, that is, the symbol B is inputted to all storage areas of each timer memory to blank all displays on the display unit. Further, a flag of a waiting state is set.

Next, in step $S_2$ it is checked whether or not there are provided pulses having a period of, for example, 100 mm sec. from the clock generator 35, and if they are provided, the corresponding one of the timer memories is counted up in step $S_3$ and then the program proceeds to step $S_4$.

In the case where no pulses are provided in step $S_2$, the program jumps over step $S_3$ to step $S_4$, in which the content of the display buffer 26 is provided to the display unit 18 and the states of the keys are scanned. By this operation, the states of the keys are entered and, in step $S_5$, it is checked whether or not any of the keys has been newly depressed. If not, the program returns to step $S_2$; if there is a depressed key, it is decoded in step $S_6$ and the program proceeds to the corresponding one of processing routines $S_7$, and after completion of the processing routine corresponding to the key, the program returns to step $S_2$.

Figure 8:
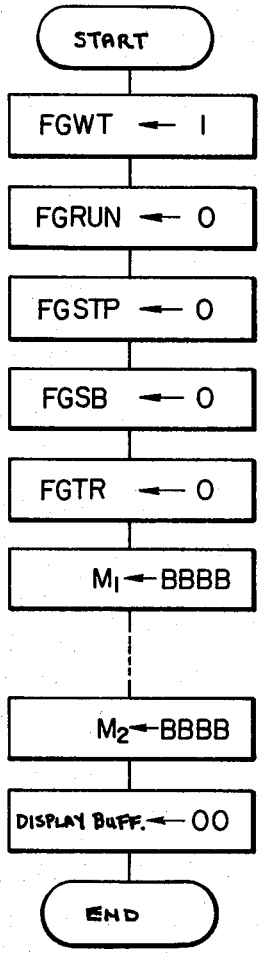

The routine of turning ON the power source in step $S_1$ will be described in more detail. As shown in FIG. 8, a flag of the wait mode is set first; a flag FGWT is set to 1; a flag FGRUN representing the running state is set to 0; and a flag FGSTP representing the stop mode is set to 0. Further, a significance flag FGSB is also set to 0 and a call flag FGTR is also set to 0. Morever, the timer memories $M_1$ to $M_0$ are put in their cleared state, that is, the symbol B is stored at each digit of them and then 0 is provided to the display buffer 26.

Figure 9:
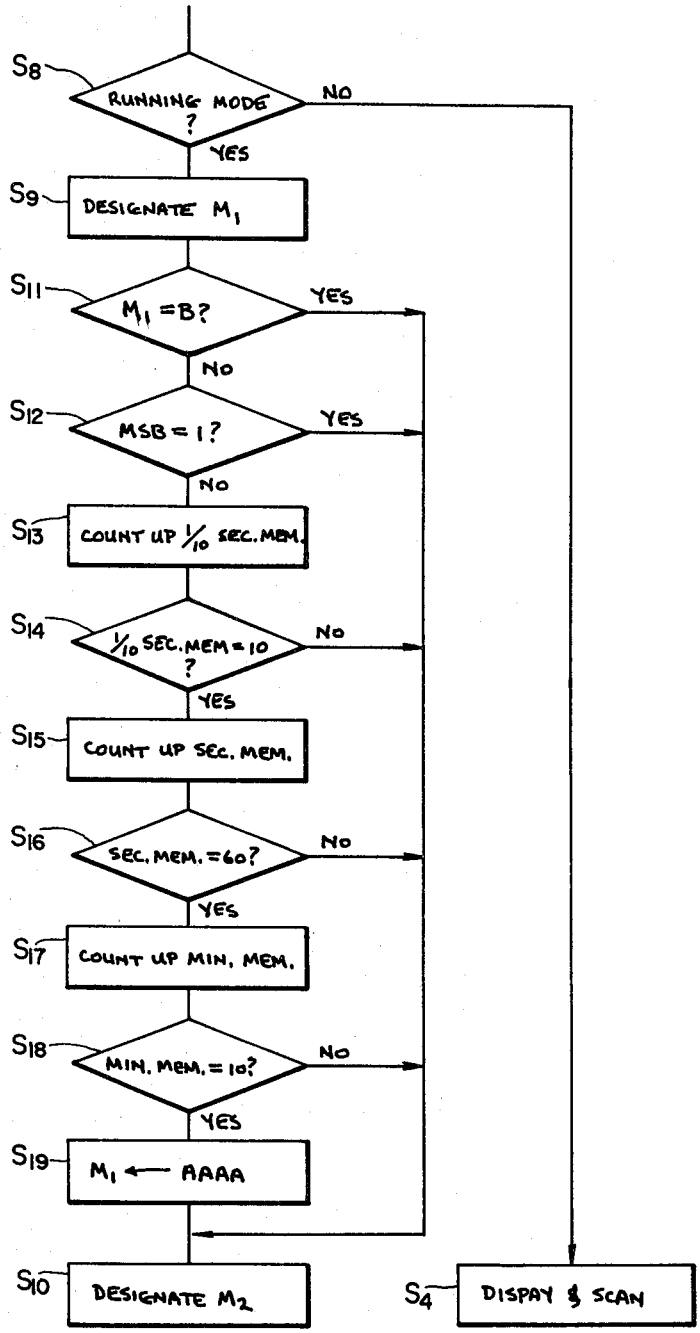
FIG. 9 is a flowchart for stepping a timer.

Next, a description will be made, with reference to FIG. 9, of an example of the routine of step $S_3$ in FIG. 1 for performing the operation of the timer memory, that is, its counting-up operation. At first, it is checked in step $S_8$ whether the mode of operation is an operating one or not; if not, the program proceeds to the display and key scanning routine $S_4$, and if the operating mode is confirmed, the timer memory $M_1$ is designated in step $S_9$ and then it is checked in step $S_{11}$ whether the stored content of that memory is B or not, that is, whether the memory is in the cleared state or not. In the case of the memory being in the cleared state, since the designated timer $M_1$ is in the wait state and is not in operation, the program proceeds to step $S_{10}$ in which the next timer memory is designated.

If the timer $M_1$ is in operation in step $S_{11}$, its stored content is not B and the program proceeds to step $S_{12}$, in which it is checked whether the most significant bit MSB in the storage area 23 of the memory $M_1$ for the second digit of a second is "1" or not. The maximum value of the second is 59 sec. and when 60 sec. is reached, it is carried up to a minute; therefore, the bit MSB in the second digit in the second memory does not become "1". Accordingly, stoppage of the operation of the timer memory is displayed by setting to "1" the bit MSB of the second digit of the second in the timer memory. In the case of the MSB being "1" in step $S_{12}$, since the timer memory $M_1$ is out of operation, the program proceeds to step $S_{10}$ in which the next timer memory $M_2$ is designated.

In the case where the bit MSB is not "1" in step $S_{12}$, the program proceeds to step $S_{13}$ in which one is added to the content of the area of the least significant digit in the timer memory $M_1$, that is, the content of the 1/10 sec. area 21; namely, the content is counted up. Then, it is checked in step $S_{14}$ whether or not the content of the 1/10 sec. has been carried up to 10; if it has not become 10, then the program proceeds to step $S_{10}$, whereas if it has become 10, then one is added to the content of the area 22 of the first digit of the second in the memory $M_1$ in step $S_{15}$.

In the next step $S_{16}$ it is checked whether or not the count value in the memory areas 22 and 23 has reached 60. If not, the program proceeds to step $S_{10}$, whereas if the count value has reached 60, a count up to the minute memory area 24 takes place in step $S_{17}$. Next, in step $S_{18}$, it is checked whether the minute memory area 24 has become 10 or not, that is, whether it overflows or not. If not, the program proceeds to step $S_{10}$, whereas if 10 has been reached, a symbol A is set in each digit of the memory $M_1$ in step $S_{19}$. As the symbol A, use is made of a value 1010 which represents 10 in decimal number. Step $S_{19}$ is followed by step $S_{10}$.

The operations after step $S_{10}$ are the same as those in steps $S_9$ to $S_{19}$. In this way, upon each detection of the clock, the count-up operation is carried out in those of the memories $M_1$ to $M_0$ which are in operation.

Figure 10:
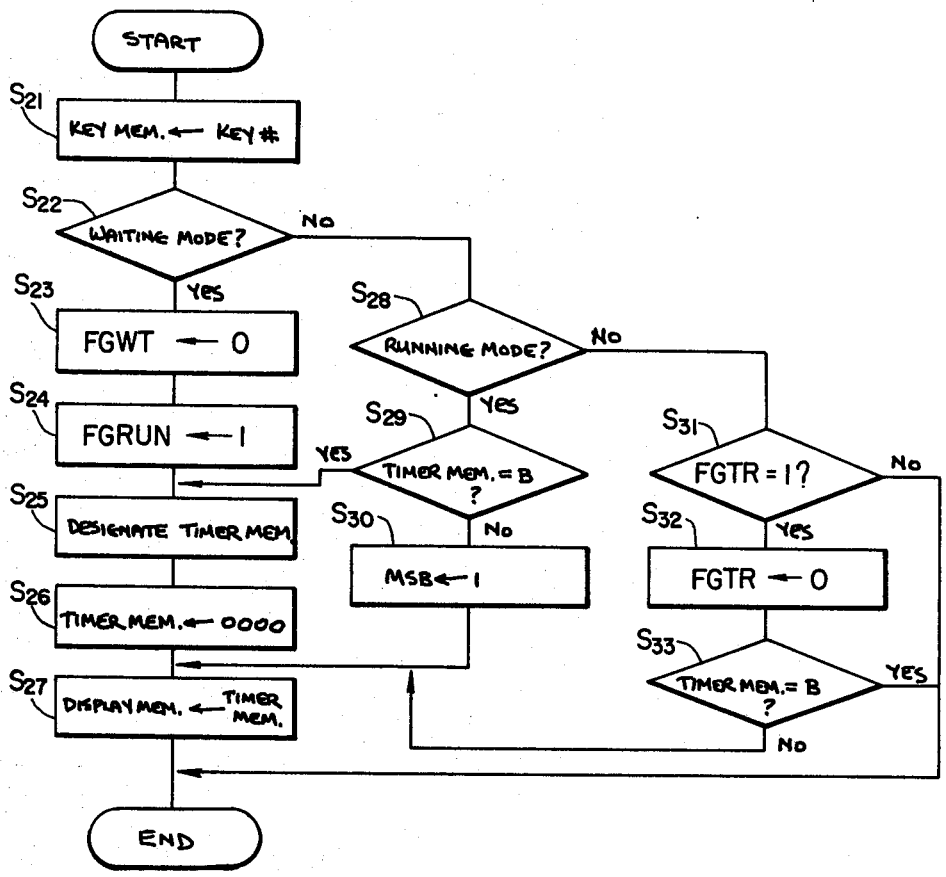
FIG. 10 is a flowchart showing a routine in the case of a key being depressed.

Next, a description will be given, with reference to FIG. 10, of the routine in the case of one of the number keys 12 is depressed. Upon depression of one of the number keys, the number representing the depressed number key is inputted to the key memory 38 in the display buffer 26 in step $S_{21}$. Next, in step $S_{22}$ it is checked whether the mode of operation is the wait mode or not, and in the case of the wait mode, the wait mode flag FGWT is set to 0 in the next step $S_{23}$ and the mode flag FGRUM is set to "1" in step $S_{24}$. In the next step $S_{22}$ the timer memory corresponding to the depressed number key is designated and, in step $S_{26}$, the contents of this memory that has stored therein B in the cleared state until then are all set to 0 in step $S_{26}$. The contents of the timer memory are transferred to the display buffer 26 in step $S_{27}$, and accordingly zeros are displayed in the minute, second and 1/10 sec. display sections of the display unit 18 and the number of the depressed number key is displayed.

Where it is detected in step $S_{22}$ that the mode is not the wait mode, it is checked in step $S_{28}$ whether the mode is the running mode or not; in the case of the operating mode, it is checked in step $S_{29}$ whether the content of the timer memory corresponding to the depressed number key is B or not. In the case of B, the program proceeds to step $S_{25}$. On the other hand, in the case where it is detected in step $S_{29}$ that the content of the timer memory is not B, that is, in the case where the timer memory is already in operation, the timer memory is stopped from operation, and in step $S_{30}$, "1" is entered to the most significant bit MSB of the area 23 for the second digit of the second in the memory. Then, the program proceeds to step $S_{27}$.

When it is detected in step $S_{28}$ that the mode is not the running mode, it is checked in step $S_{31}$ whether the call flag FGTR is "1" or not. In the case of "1", the flag is returned to "0" in step $S_{32}$ and in step $S_{33}$ it is checked whether the content of the timer memory is B or not. If not, its effective digits alone are transferred to the display buffer in step $S_{27}$. In the cases where the timer call flag is not "1" in step $S_{31}$ and where the timer memory is in the cleared state, that is, its content is B in step $S_{33}$, the operation comes to an end.

Figure 11:
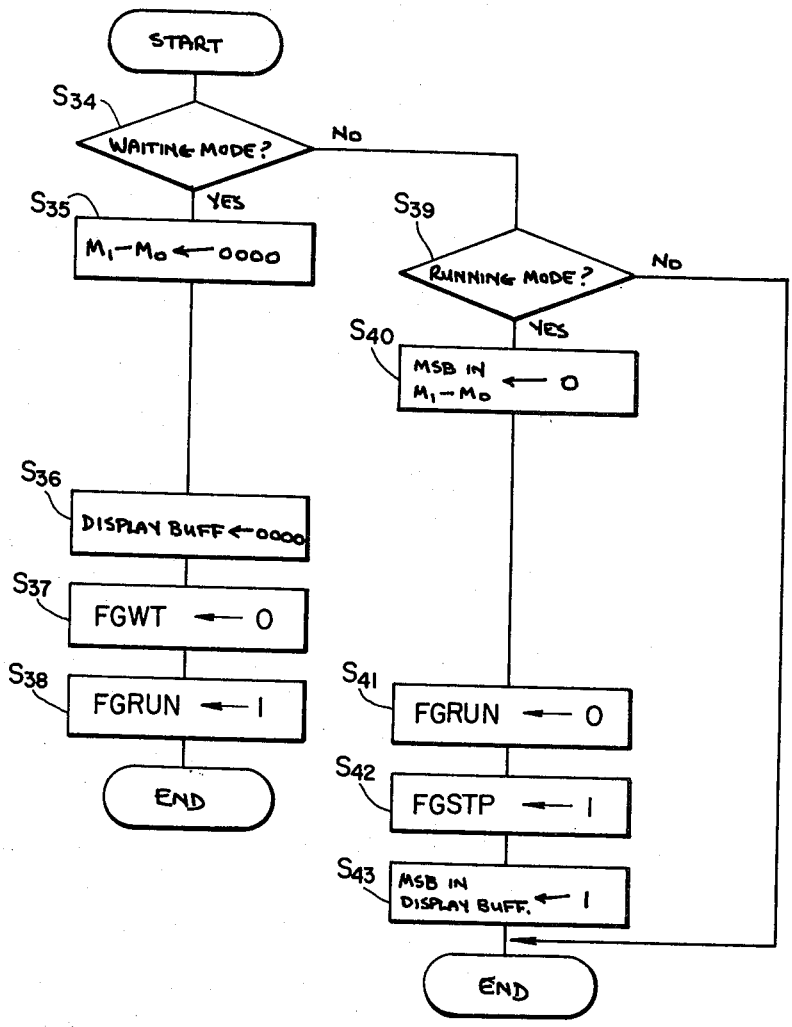
FIG. 11 is a flowchart showing a routine in the case of a simultaneous start key being depressed.

Next, a description will be given, with reference to FIG. 11, of the operation in the case of the simultaneous start key 15 being depressed. At first, it is checked in step $S_{34}$ whether the mode is the wait mode or not; in the case of the wait mode, the cleared states of the timer memories $M_1$ to $M_0$, that is, their B storing states are all set to "0" in step $S_{35}$, and the display buffer 26 is supplied with "0" in step $S_{36}$. In step $S_{37}$ the wait mode flag FGWT is reset to 0, and in step $S_{33}$ the running mode flag FGRUN is set to "1".

In the event that the mode is not the wait mode in step $S_{34}$, it is checked in step $S_{39}$ whether the mode is the running mode or not; if so, the most significant bit of the second digit of the second in each of the timer memories $M_1$ to $M_0$ is set to "0" in step $S_{40}$ and the timer memories are all stopped from operation.

Next, in step $S_{41}$ the running mode flag FGRUN is reset to "0", and in step $S_{42}$ the stop mode flag FGSTP is set to "1", and in step $S_{43}$ "1" is entered to the most significant bit MSB for the second digit of the second in the display buffer 26. If it is detected in step $S_{39}$ that the mode is not the running mode, it means the stop mode and such an operation is ignored and terminated.

Figure 12:
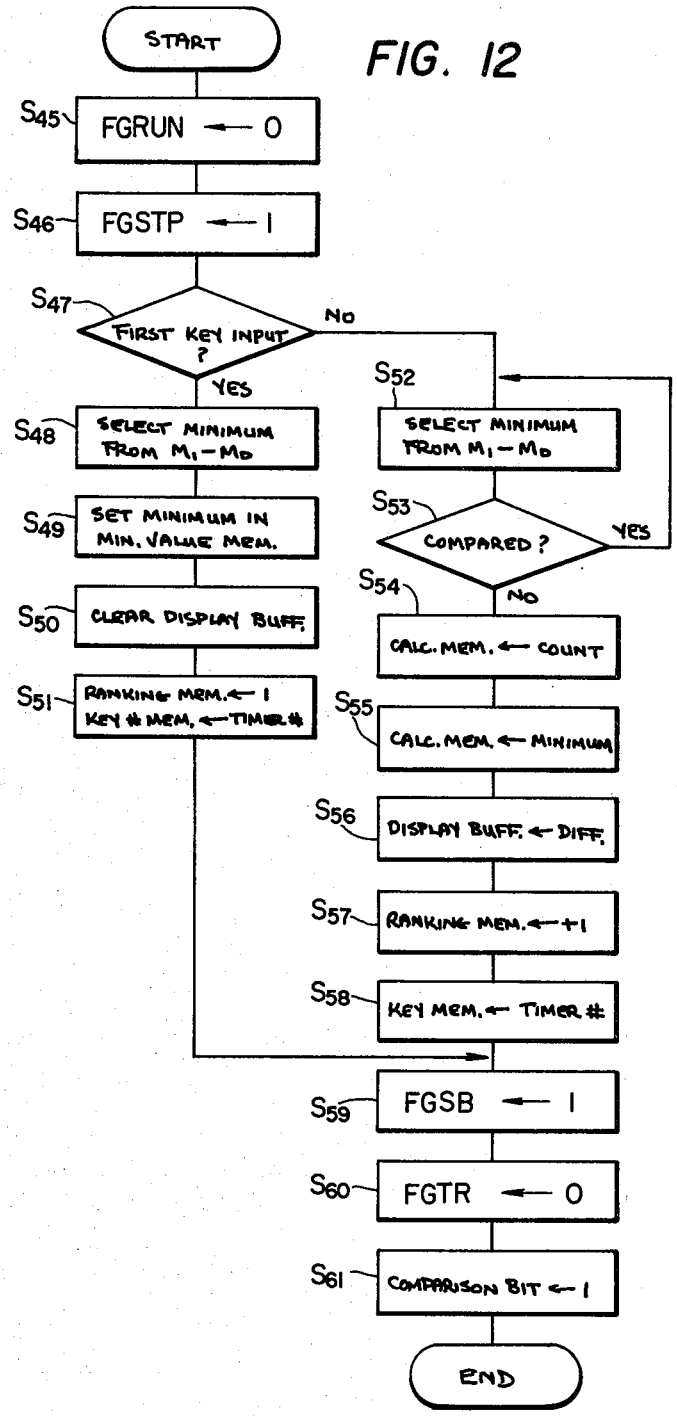
FIG. 12 is a flowchart showing a routine in the case of a relative difference key being depressed.

Next, a description will be given, with reference to FIG. 12, of the operation in the case of the relative difference key 13 being depressed. At first, the running flag FGRUN is reset to 0 in step $S_{45}$ and then in step $S_{46}$ the stop mode flag FGSTP is set to "1". In the next step $S_{47}$ it is checked whether the relative difference key has been depressed a first time or not; if so, a minimum value among the stored contents of the timer memories $M_1$ to $M_0$ is selected in step $S_{48}$. The minimum value thus selected is set in the minimum value memory in step $S_{49}$. In step $S_{50}$, the display buffer memory 26 is cleared, and in step $S_{51}$, 1 is inputted to the ranking display section 39 in the display buffer and the number of the corresponding memory is loaded in the key number display section 38.

When it is detected not to be the first time that the relative difference key was depressed, a minimum value among the stored contents of the memories $M_1$ to $M_0$ is selected in step $S_{52}$. In step $S_{53}$, it is detected whether or not the memory of the minimum value thus selected has already been compared with the content of the minimum value memory; if so, the program returns to step $S_{52}$ to select a minimum value again. Thus, a minimum one of those values which have not been compared yet is selected. The minimum value thus selected is transferred to the calculation memory 27 in step $S_{54}$. In step $S_{55}$, this minimum value is compared with the content of the minimum value memory 25 to detect the difference therebetween, and this difference is inputted to the display buffer 26 in step $S_{56}$.

Next, in step $S_{57}$ one is added to the content of the ranking display section 39 of the display buffer, and in step $S_{58}$ the number of the number key corresponding to the memory from which the minimum value has just been taken out is transferred to the key number section 38 of the display buffer. In step $S_{59}$ the ranking flag FGSB is set to "1", and in step $S_{60}$ the call flag FGTR is reset to "0". In step $S_{61}$, in the timer memory whose content has been displayed, a bit indicating that the content has been compared with the content of the minimum value memory and displayed is made "1". Accordingly, it is detected by checking this bit in step $S_{53}$ whether or not the content of selected timer memory has already been compared with the content of the minimum value memory. After step $S_{61}$, the program ends.

Figure 13:
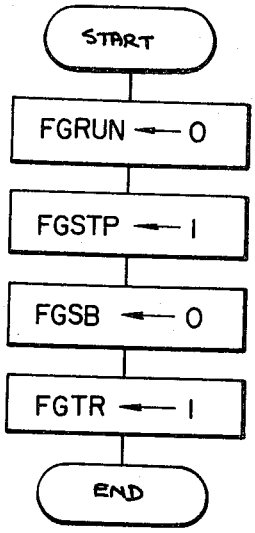
FIG. 13 is a flowchart showing a routine in the case of a time key being depressed.

When the time key is depressed, the running flag FGRUN is reset to "0"; the next stop flag FGSTP is set to "1"; the ranking flag FGSB is reset to "0"; and the call flag FGTR is set to "1", thus completing the program, as shown in FIG. 13.

Figure 14:
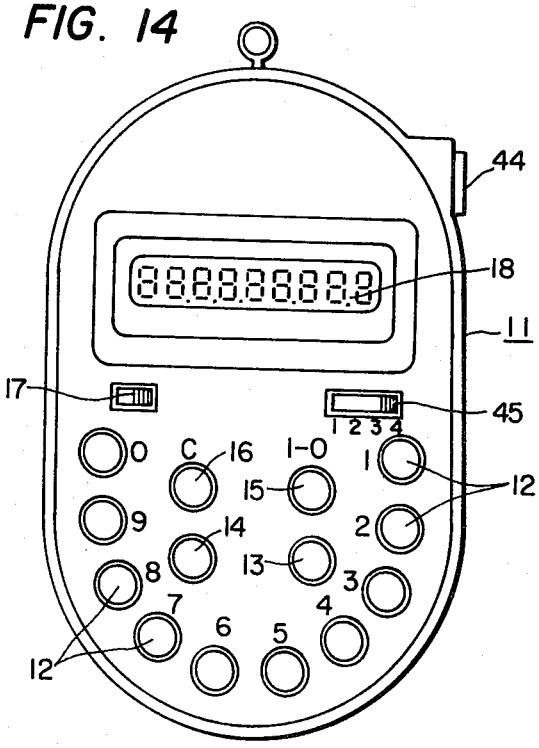
FIG. 14 is a plan view illustrating another embodiment of the relative time interval measuring instrument of this invention.

FIG. 14 illustrates another example of the relative time interval measuring instrument of this invention. This example is equipped with the function of stopping the timer memories from operation in a predetermined order upon each depression of one key, in addition to such functions of the foregoing embodiment as described previously in respect of FIGS. 1 to 13. In this example, parts corresponding to those in FIG. 1 are indicated by the same reference numerals, and an auto-key 44 is provided on one side of the case 11. The position and the direction of control of the auto-key 44 are selected so that it may easily be manipulated by any one of fingers of one hand holding the casing 11. In this example, the auto-key 44 is disposed on the right upper side of the case in the drawing.

Further, in order to provide various functions, a mode changeover switch 45 is disposed on the front of the case 11 together with other keys. The mode changeover switch 45 is to select one of first to fourth modes. When it is set to the first-mode position, exactly the same operations as those in the foregoing first embodiment are carried out and, in this case, even if the auto-key 44 is operated, it is neglected. When the mode changeover switch is set to the second-mode position, the timer memories can be selectively operated by the number keys 12 and can be started simultaneously by the simultaneous start key 15. As to the stopping of the memories from operation, in addition to the simultaneous stop by the simultaneous start key 14, they are stopped by each depression of the auto-key 44 in a predetermined sequential order, for example, in the order of the numbers 1, 2, 3 . . . of the number keys respectively corresponding to the timer memories. The operations by the relative difference key 13 and the time key 14 are the same as those in the first embodiment.

When the mode changeover switch 45 is set to the third mode, the depression of the auto-key 44 simultaneously starts the timer memories $M_1$ to $M_0$, and by each subsequent depression of the auto-key 44, the timer memories are stopped one by one in the order $M_1$, $M_2$, . . . . In the second and third modes, the timer memories can thus be stopped in a sequential order merely by each depression of the auto-key 44. Accordingly, for example, in the case of a footrace, by starting the timer memories all together simultaneously with the start of the race and depressing the auto-key at every moment of each racer reaching the goal, the lap times of the first, second, third, . . . places are respectively counted; in this case, since it is sufficient only to depress the same auto-key 44 without the necessity of depressing the individual number keys, a correct manipulation can be achieved while observing the racers reaching the goal, without checking the key to be depressed. In the third mode, even if keys other than the auto-key 44 and the clear key 16 are depressed, they are neglected. Therefore, in order to display the count values of the timer memories and their relative differences after measurement, the mode changeover switch 45 is set to the first mode.

The fourth mode is suitable for counting the time limit, for example, in the games of shogi, go, chess and so forth. In an additive system, the present time is set by depressing the number key 12, and thereafter, start and stop of the timer are repeated upon each depression of the auto-key 44. When the timer is started, an additive counting is effected with respect to the above set time. In a subtractive system, for example, a first time limit is set by the number key 12, and thereafter, upon each depression of the auto-key, start and stop of the timer are repeated, and during starting, a subtraction from the abovesaid time limit is performed.

Figure 15:
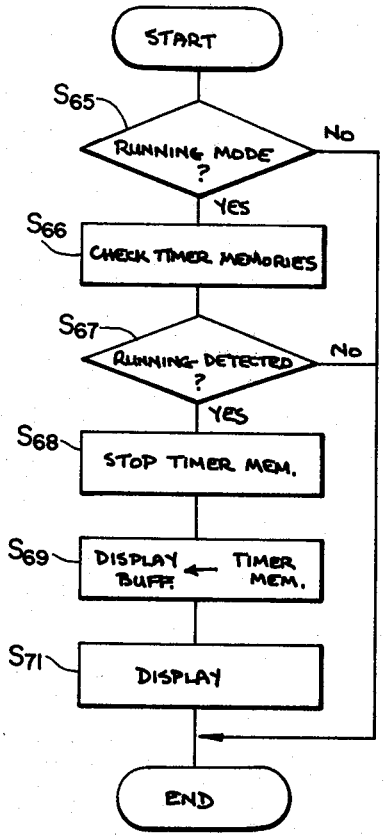
FIG. 15 is an operational flowchart in the case of an automatic key being turned ON in second and third modes.

In FIG. 15 there is shown a flowchart of operation in the case of the auto-key 44 being depressed in the second and the third mode. Upon depression of the auto-key 44, it is checked in step $S_{65}$ whether the mode is the running mode or not; if it is, the timer memories $M_1$ to $M_0$ are checked in this order, in step $S_{66}$, as to whether they are in operation or not. In step $S_{67}$, when a first one of the timer memories in operation is detected, the operation of the detected timer memory is stopped in step $S_{68}$. The content of the stopped timer memory is transferred to the display buffer in step $S_{69}$ and displayed in step $S_{71}$, thus completing the program. In the cases where the mode is not the running mode in step $S_{65}$ and where no timer memories in operation are detected in step $S_{67}$, the program comes to an end.

Figure 16:
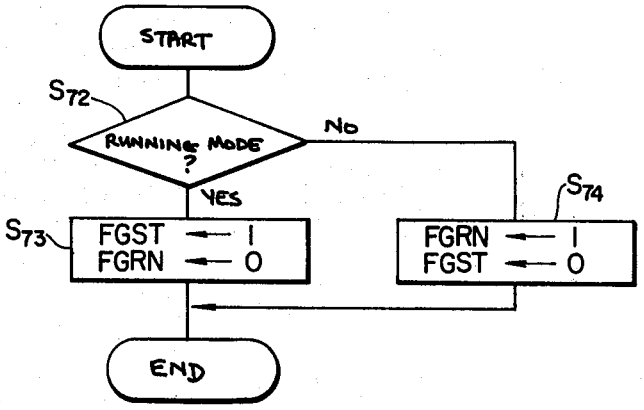
FIG. 16 is an operational flowchart in the case of the automatic key being turned ON in a fourth mode.

In the fourth mode, an input of a numerical value by the number key 12 is carried out in the same manner as an input of a numerical value to an ordinary desk electronic calculator; namely, upon each depression of a number key, the numerical value corresponding to the number key is inputted and the display of the numerical value inputted before is shifted to the left by one bit position. In the case of the auto-key 44 being depressed, it is checked in step $S_{72}$ whether the mode is the running mode or not; if it is, the stop mode flag FGSTP is set to 1 and the running mode flag FGRUN is set to 0 in step $S_{73}$, providing the operative state and completing the program, as shown in FIG. 16. If the running mode is not detected in step $S_{72}$, then the running mode flag FGRUN is set to "1" and the stop mode flag FGSTP is set to "0" to provide the stop state, completing the program.

Figure 17:
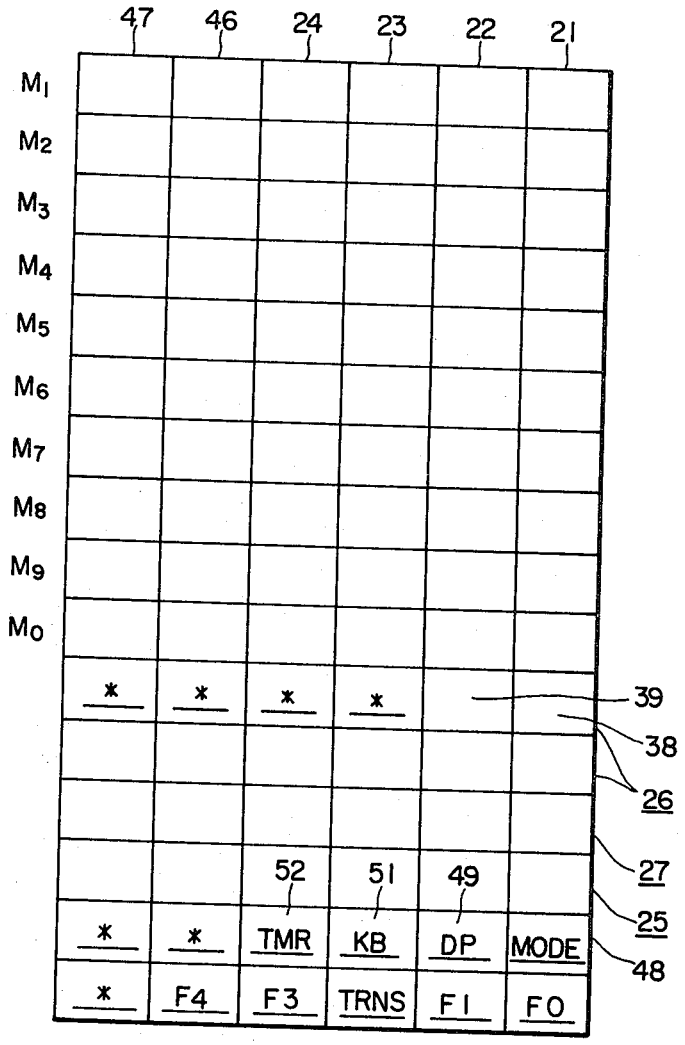
FIG. 17 is a block diagram showing examples of memories for use in the relative time interval measuring instrument shown in FIG. 14.

In the instrument of FIG. 14 the timer time can be measured and displayed to the unit of hours. To this end, as shown in FIG. 17, a minute higher-order digit display section 46 and an hour display section are added to the respective timer memories $M_1$ to $M_0$ in addition to the display sections shown in FIG. 2. As the display buffer 26, use is made of a 2-word buffer. The changeover position of the mode changeover switch 45 is entered into a memory part 48. A memory part 49 for key scanning, a memory part 51 for key information, a memory part 52 for counting the key chattering absorbing time, a memory part 53 for the mode flags, i.e. the wait mode flag FGWT, the running mode flag FGRN, the stop mode flag FGST and the additive or subtractive mode flag FGAS and a memory part 54 for the call flag FGTR, the relative difference flag FGSB and the first relative difference key input flag FGSUB are not shown in FIG. 2 but are similarly provided in the first embodiment, too.

Figure 18:
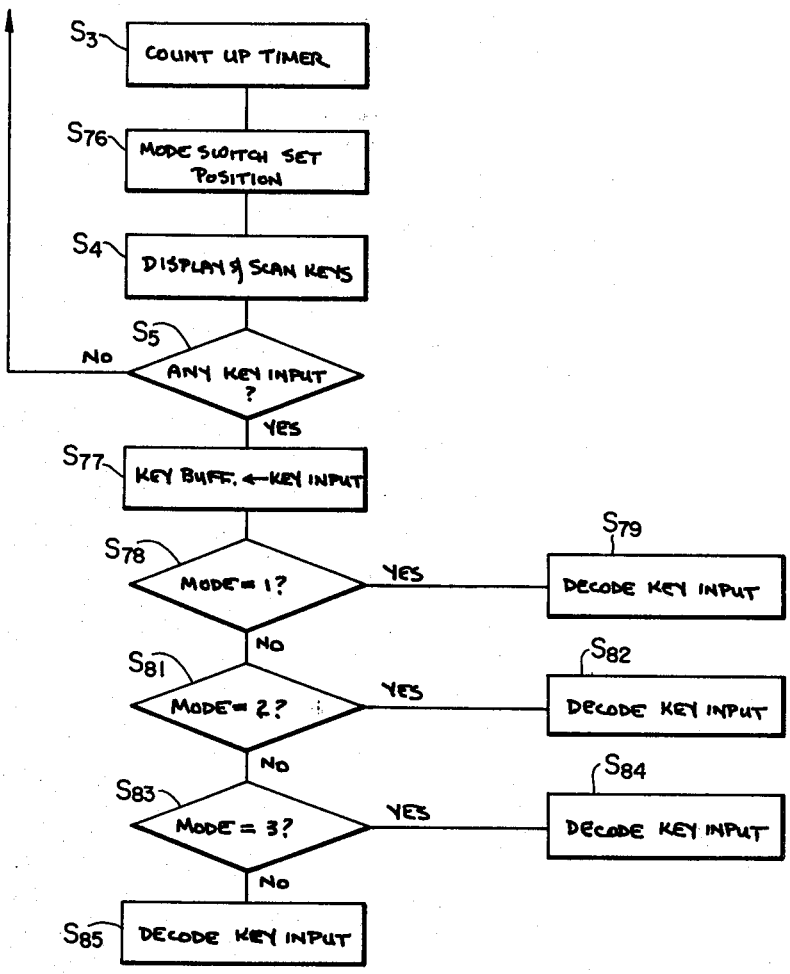
FIG. 18 is a flowchart showing those parts of the entire operation of the relative time interval measuring instrument of FIG. 14 which differ from those in FIG. 7.

A description will be given, with reference to FIG. 18, of those parts of the entire operational flowchart of the embodiment of FIG. 14 which are different from the flowchart of FIG. 7. When the timer counting up takes place in step $S_3$, the set position of the mode changeover switch 45 is entered to the memory part 48 of FIG. 17 in step $S_{76}$. Then, the program proceeds to step $S_4$. If it is decided in step $S_5$ that there is a key input, this input is loaded in the key buffer memory part 51 in step $S_{77}$. Thereafter, in step $S_{78}$, the content of the memory part 48 is read, by which it is decided whether the mode changeover switch is set to the first mode or not; if it is, the key input is decoded in step $S_{79}$ and the corresponding key processing is carried out in the next step. In the case where the first mode is not detected in step $S_{78}$, it is decided in step $S_{81}$ whether the mode is in the second mode or not, if it is, the key input is decoded in step $S_{82}$ and the key processing corresponding to the second mode takes place in the next step. In this way, that same key enables different key processings depending on the modes. The subsequent operations are carried out in a manner similar to the described above. Namely, in the case where the second mode is not detected in step $S_{81}$, it is decided in step $S_{83}$ whether the mode changeover switch is set to the third mode or not; if it is, the key input is decoded in step $S_{84}$ and the key processing takes place in the next step. If the third mode is not detected in step $S_{83}$, the key input is decoded in the fourth mode in step $S_{85}$ and the key processing is performed in the next step.

As has been described in the foregoing, according to the relative time interval measuring instrument of this invention, a plurality of time intervals can be measured with one instrument. Further, it is possible to display one of the measured time intervals, erase it and display another measured time interval and then display the first measured time interval again. That is to say, the same measured value can be repeatedly displayed; hence, there is no need of recording the individual measured values on a record paper or the like.

Moreover, in the relative difference mode by depressing the relative difference key, a difference between each of a plurality of measured value and a minimum one of them is displayed quantitatively, by each depression of the key, along with its ranking and the corresponding key number. In the foregoing, a minimum one of measured value is selected and displayed as the first place and a second minimum value is displayed as the second place; but it is also possible to display a maximum one of the measured value as the first place and a second maximum value as the second place, together with a difference therebetween. The term "minimum" used in the appended claims is therefore intended to cover the term "maximum" as well.

In the above description, the number of the objects of measurements is ten at most but this number can be selected at will. The unit of time to be measured can also be selected variously according to the particular application. The operations described above need not always be carried out under program control but may also be performed by pure electrical circuit arrangements.

What is claimed is:

1. A relative time interval measuring instrument comprising a plurality of number keys; a relative difference key; a plurality of timer memories respectively corresponding to said number keys and each of which is individually adapted to performing counting operations during time intervals defined by depression of their associated number keys; a display unit; and control means connected to the number keys, the relative difference key, the timer memories and the display unit; said control means comprising timer memory starting means for starting the counting operations of the timer memories in response to depression of the corresponding number keys, timer memory stopping means for stopping the operations of the timer memories in response to subsequent depression of the corresponding number keys, means responsive to depression of the relative difference key for selecting a minimum value from the count contents of the timer memories and calculating the differences between said minimum value and each of the count contents of the timer memories in a sequential order upon each depression of the relative difference key, and display means for displaying on said display unit the calculated difference relative to said minimum value, the number of the number key corresponding to the timer memory whose count content is used to calculate the difference, and the ranking of the count content.

2. A relative timer interval measuring instrument according to claim 12 including a simultaneous start key, said control means including means responsive to depression of said simultaneous start key for setting the timer memory starting means to start the operations of all of said timer memories together.

3. A relative time interval measuring instrument according to claim 2 wherein the timer memory stopping means is responsive to a subsequent depression of said simultaneous start key for stopping the count operations of all the timer memories simultaneously.

4. A relative time interval measuring instrument according to claim 1 including a time key, said control means being responsive to depression of said time key and each number key to cause said display means to display on said display unit the content of the timer memory corresponding to the depressed number key and the number of the depressed number key.

5. A relative time interval measuring instrument according to claim 1 including an auto-key connected to said control means, said timer memory stopping means being responsive to each depression of said auto-key to stop the operations of different ones of said timer memories in a predetermined order.

6. A relative time interval measuring instrument according to claim 5 wherein the timer memory starting means is operative to place all of said timer memories simultaneously into counting operations in response to a first depression of said auto-key.

7. A relative time interval measuring instrument according to claim 6 including a mode changeover switch connected to said control means for changing the operation mode of said instrument such that, in one position of the mode changeover switch, the timer memories are stopped from operation one after another upon each depression of the auto-key, and in another position of said mode changeover switch a numerical value is set by the control of one of the number keys in one of the timer memories and start and stop of the timer operation for addition to or subtraction from the numerical value set in the timer memory is repeated upon each depression of the auto-key.

* * * * *